US008708421B2

(12) United States Patent
Junker et al.

(10) Patent No.: US 8,708,421 B2
(45) Date of Patent: Apr. 29, 2014

(54) METHOD FOR PRODUCING A FACE OPENING USING AUTOMATED SYSTEMS

(75) Inventors: Martin Junker, Essen (DE); Armin Mozar, Hamm (DE)

(73) Assignee: RAG Aktiengesellschaft, Herne (DE)

( * ) Notice: Subject to any disclaimer, the term of this patent is extended or adjusted under 35 U.S.C. 154(b) by 0 days.

(21) Appl. No.: 13/391,360

(22) PCT Filed: Aug. 20, 2009

(86) PCT No.: PCT/EP2009/006033
§ 371 (c)(1),
(2), (4) Date: Mar. 13, 2012

(87) PCT Pub. No.: WO2011/020484
PCT Pub. Date: Feb. 24, 2011

(65) Prior Publication Data

US 2012/0161493 A1 Jun. 28, 2012

(51) Int. Cl.
*E21C 35/08* (2006.01)

(52) U.S. Cl.
CPC ..... *E12C 35/08* (2013.01)
USPC ..... 299/1.7; 299/42

(58) Field of Classification Search
USPC ..... 299/1.05, 1.1, 1.2, 1.6, 1.7, 42, 53, 54
See application file for complete search history.

(56) References Cited

U.S. PATENT DOCUMENTS 5,228,751 A * 7/1993 Ramsden, Jr. ..... 299/1.6
5,423,638 A 6/1995 Merriman
5,553,925 A * 9/1996 Merten et al. ..... 299/1.1
6,857,705 B2 * 2/2005 Hainsworth et al. ..... 299/1.7
2009/0035072 A1 2/2009 Koenig
2010/0117439 A1 5/2010 Klabisch et al.
2012/0038205 A1 * 2/2012 Mundry et al. ..... 299/43

FOREIGN PATENT DOCUMENTS

DE 198 14 246 10/1999
DE 102007060170 7/2008
WO WO 2006119534 A1 * 11/2006

* cited by examiner

*Primary Examiner* — David Bagnell
*Assistant Examiner* — Michael Goodwin
(74) *Attorney, Agent, or Firm* — Jennifer S. Stachniak; Robert W. Becker

(57) ABSTRACT

Method of automatically producing a defined face opening, in underground coal mining, during longwall mining operations having a face conveyor, a disk shearer loader and a hydraulic shield support. Via at least one inclination sensor on the top canopy of the shield support frame, the inclination of the top canopy relative to the horizontal, in the direction of mining or extraction of the disk shearer loader, is determined to provide angles of the course of an overlying stratum at the shield support frame. A stepping path length of each shield support frame is detected, and therefrom a cutting depth of the disk shearer loader during an extraction run is determined. A cutting height of the disk shearer loader is detected by means of sensors disposed thereon, and a cutting height of the disk shearer loader is adjusted in alignment with the angle of the course of the overlying stratum to produce the defined face opening.

20 Claims, 5 Drawing Sheets

METHOD FOR PRODUCING A FACE OPENING USING AUTOMATED SYSTEMS

BACKGROUND OF THE INVENTION

Figure 1:
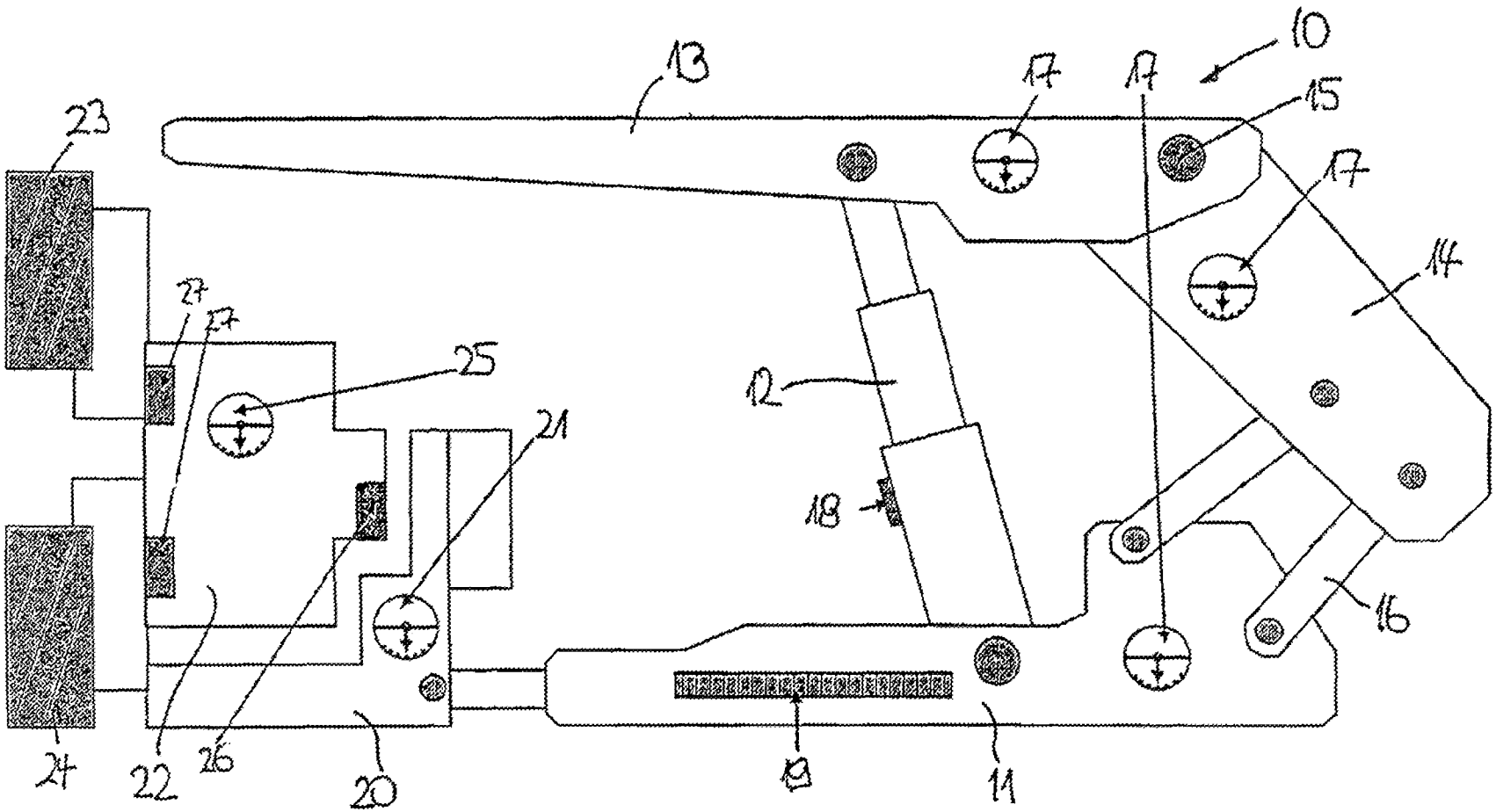

The instant application should be granted the priority dates of Aug. 20, 2009, the filing date of the international patent application PCT/EP2009/006033.

The present invention relates to a method for automatically producing a defined face opening, in underground coal mining, during longwall mining operations having a face conveyor, disk shearer loader as an extraction machine, and a hydraulic shield support.

One problem with automatically controlling longwall mining operations, not only in the direction of mining but also in the direction of extraction of the disk shearer loader, is, for example, on the one hand to produce an adequately large face opening in order to ensure the passage of the longwall equipment, for example without collisions between disk shearer loader and shield support frames as the disk shearer loader passes by, and on the other hand to keep the amount of waste rock as small as possible during the extraction work, accordingly, limiting the extraction work as much as possible to the seam layer without cutting too much country rock along with it. The deposit or seam data that is practically available prior to the extraction concerning the seam thickness, the level of the footwall or overlying stratum, and the presence of saddles and/or troughs not only in the direction of mining but also in the longitudinal direction of the longwall equipment, in other words in the direction of extraction of the disk shearer loader, are too imprecise in order therefrom to support an automated control of the extraction and support work.

It is therefore an object of the present invention to provide a method of the aforementioned general type by means of which, on the basis of the data obtained at the longwall equipment, to enable an automation of the extraction and support work with respect to the production of a defined face opening.

SUMMARY OF THE INVENTION

The basic concept of the present invention is a method for the cutting extraction with a disk shearer loader, with which, via at least one inclination sensor mounted on the top canopy of the shield support frames, the inclination of the top canopy relative to the horizontal plane in the direction of mining and/or in the direction of extraction of the disk shearer loader is determined, and from the thus determined angles of the course of the overlying stratum at the shield support frames, the course of the overlying stratum is determined, and with which, by detecting the stepping or advancement path length of each shield support frame by means of a distance measuring device disposed on the floor skid of the shield support frame, the cutting depth of the disk shearer loader is determined during each extraction run, and with which furthermore, by means of sensors mounted on the disk shearer loader, the cutting height of the disk shearer loader is detected, whereby the adjustment of the cutting height of the disk shearer loader is in alignment with the respective angle of the course of the overlying stratum to produce the defined face opening.

The present invention has the advantage that primarily, on the basis of the angle of a course of the overlying stratum at the shield support frames, which is to be determined at relatively little expenditure, a parameter having an adequate precision and reliability is available for the face control. The other parameters that are inventively used comprise on the one hand the detection of the cutting guidance of the extraction machine by determining its absolute cutting height, and on the other hand the respective cutting depth that is to be derived from the detection of the stepping or advancement path length of the individual shield support frames. On the basis of the thus obtained data, it is possible to use the overlying stratum as a guide parameter for the cutting operation.

The control of the cutting operation can be further improved if, by means of inclination sensors mounted on at least three of the four main components of each shield support frame, such as floor skid, gob shield, supporting connection rods and top canopy, the inclination of the top canopy relative to the horizontal is determined, and from the measured data, in a computer, by comparison with base data stored therein that defines the geometrical orientation of the components and their movement during the stepping or advancement, the respective shield height, perpendicular to the stratification, is determined in the region between the top canopy and the floor skid, and therefrom, taking into consideration the overall height of the top canopy and floor skid, the height, perpendicular to the stratification, of the longwall cut free by the disk shearer loader is determined, and with which, on the basis of the obtained data, the geometry of the cut-free longwall is determined at each shield support frame. By using the shield height as a further parameter or guide parameter, a geometry of the longwall respectively produced by the disk shearer loader can be calculated, which over a plurality of successive extraction runs also enables the establishment of a model of the course of the seam layer in the direction of mining, which can be compared with the available deposit or seam data. With this data it is considerably more possible to prescribe, and also to maintain during operation, a cutting profile for the disk shearer loader that is to be automatically used over an extraction run of the disk shearer loader, as well as over a plurality of successive extraction runs.

Pursuant to one exemplary embodiment of the invention, the cutting heights of the leading overlying stratum disk that carries out the overlying stratum cut, and of the trailing disk that carries out the footwall cut, are determined on the basis of sensors that detect the position of the support arms of the disks, and as the disk shearer loader passes by each shield support frame, the overall cutting height is specified in a relationship to the face opening mathematically determined at the pertaining shield support frame. This enables a coordination of the travel of the disk shearer loader through the face with the position of the individual shield support frame of the shield support that is utilized.

Pursuant to an exemplary embodiment of the invention, the inventive control process is improved by determining the inclination of conveyor and/or disk shearer loader relative to the horizontal in the direction of stepping or advancement of the shield support frames by means of inclination sensors mounted on the conveyor and/or the disk shearer loader. Hereby, the arrangement of an inclination sensor on the disk shearer loader is initially sufficient. Although the disk shearer loader, which travels on the face conveyor and is guided thereon, to a certain extent forms a unit with the face conveyor, to improve the precision of the control it can be expedient to also detect the inclination of the face conveyor via an inclination sensor disposed thereon. The arrangement of an inclination sensor only on the face conveyor can already be adequate for the purposes of the control.

The angle of inclination of conveyor and/or disk shearer loader can be specified in a relationship to the angle of inclination determined at the floor skid of the shield support frame and/or at the top canopy, and the differential angle formed therefrom can be included in the calculation of the face opening that is established with a plurality of successive extraction runs of the disk shearer loader. This has the advantage that this is better controllable when encountering seam troughs or seam saddles, since the historical course of the seam that has become recognizable up to the front of the face can be used for the control, so that by timely control of the extraction activity, influence can be had upon position and cross-section, and hence the geometry, of the longwall in the seam layer.

The comparison of the target shield height with the actual shield height can be overridden by encountering convergence, which reduces the freely cut face opening opposed to the support action of the shield support that is utilized. For example, pursuant to one exemplary embodiment of the invention, when the shield height falls below the value for the cutting height, the convergence that occurs is determined, and the convergence can be compensated for by an adaptation of the cutting height of the disk shearer loader, preferably by an increase of the so-called undercut, with which the footwall disk cuts into the footwall layer, since generally a cutting into the overlying stratum is to be avoided. With this measure, the influence of the convergence upon the height of the longwall can be compensated for in a defined manner. In this connection, in the case of a planned stoppage of operation, the face opening can also be increased by the amount of a convergence that is to be anticipated over the duration of the shutdown.

To the extent that the seam layer that is to be mined frequently has pronounced troughs and/or saddles in the direction of mining, these troughs and saddles can in the course of the seam layer also be determined on the basis of the data for the position of the shield support frames, and the extraction work of the disk shearer loader can be oriented thereto. Thus, for example, the encountering of a saddle is recognized by the ascertained change in inclination of the top canopy of the shield support frame that is present at or rests against the overlying stratum. From the amount of the inclination change between two extraction steps of a shield support frame, the change in height can be calculated in the sense of a reduction of the height for each further stepping process of the pertaining shield support frame. To keep the face opening at the desired target level, and to counter the reduction of the face opening, a control movement of the extraction machine for carrying out an undercut, in other words a cut into the footwall layer, is to be initiated. Subsequently, prior to passing over a saddle high point, a change in inclination of the top canopy relative to the horizontal is recognizable. This is to be relied upon to timely control the cutting operation with a restoring of the undercut achieved in the meantime, so that also when the saddle is traveled over, the target height of the face opening is maintained. Corresponding control processes, although with reversed signs, are to occur when passing through a trough, where in principle the same directional procedures exist.

The inclination sensors disposed on the shield support frames also provide a measure for the inclination of the shield support frames transverse to the direction of mining, since also in the extraction direction of the disk shearer loader in the course of the face saddles and troughs can be pronounced. Since the course of the overlying stratum and of the footwall in the longitudinal direction of the longwall equipment can be derived from the transverse inclination of the shield support frames, the possibility exists to control the leading overlying stratum disk and the trailing footwall disk of the disk shearer loader via a continuous cutting guidance in such a way that no undesired overlying stratum cut or no footwall cut that possibly goes beyond the necessary amount is effected, so that an unnecessary cutting along of rock, or an annexing of coal, or the occurrence of narrow locations between disk shearer loader and shield support, are avoided.

In the operational practice of the coal mining, a start toward automating the extraction work exists by, prior to initiating the extraction, undertaking a manually controlled trial run of the disk shearer loader, with which a manual alignment of the disks at the overlying stratum layer and relative to the footwall layer is effected. The cutting profile achieved during the trial run is detected and is stored in a computer, whereby during the extraction runs that are subsequent to the trial run, the disk shearer loader automatically follows the stored cutting profile. This has the drawback that if changes to the seam layer occur, such as changing thickness or the occurrence of a wave-like stratification with saddles and troughs, at least in portions of the face, the stored cutting profile continues to be worked by the disk shearer loader, which very rapidly leads to undesired operating conditions and makes a new manual trial run necessary. A further drawback is that the cutting profile always proceeds from a cutting depth of the disks that remains the same, and to this extent cutting depths that change over the course of the face or longwall are not taken into consideration for the subsequent establishment of the extraction work.

Additionally including or taking into account this way of proceeding during the adjustment of the cutting height of the disk shearer loader on the basis of the determined angles of the course of the overlying stratum, or of the geometry of the face area produced as calculated from the detected data, provides the possibility of an early recognition if or that the prescribed cutting profile of the disk shearer loader still corresponds to the actual geological conditions, and if deviations have occurred, of intervening in the cutting guidance of the disks, including the adaptation of their cutting depth, before undesired operating conditions arise. In this manner, the cutting guidance can be retained for a longer period of time in the face layer, so that a new trial run for establishing a changed cutting profile need be carried out less seldom. Furthermore, a cutting profile that is respectively actualized or updated to the geological conditions provides the possibility, when traveling through face zones having breakouts of the overlying stratum, where the measurement of the inclination of the top canopy of the shield support inevitably leads to false assumptions regarding the general course of the overlying stratum layer, of maintaining the last achieved cutting profile—then unchanged—until, after travel through the breakout zone, the top canopy of the pertaining shield support frame again has contact with the undamaged or intact overlying stratum layer.

The aforementioned combined use of the control actions is also applicable when taking into account the inclination position of the disks of the disk shearer loader in that during the trial run of the disk shearer loader, the longitudinal angle of inclination and/or the transverse angle of inclination of the disks of the disk shearer loader relative to the vertical is determined, and is used when establishing the cutting profile that is to be followed, whereby angle deviations that occur with the subsequent extraction runs are compensated for. Since the footwall disk produces the support surface for the face conveyor and the shield support, deviations in the angular position, especially of the footwall disk, lead to a tilting of the cutting plane of the disk shearer loader, whereby this tilting is progressively increased with successive extraction runs; thus, with undercuts of the disk that are required, a dipping effect of the longwall equipment is increased, and with upper-cuts of the disk that are required to adapt to changes in the course of the overlying stratum, a climbing effect of the longwall equipment is increased. Therefore, when angle deviations are identified, it is intended to undertake a correction.

Another start for automation also known in the operational practice is, on the basis of the data of an infrared camera that is disposed on the disk shearer loader, and is oriented toward the coal face, to determine the position of stone bands or similar rock material embedded in the seam layer, and, on the basis of a seam-inherent, known position of the stone band in relationship to the overlying stratum, to determine during the extraction run the course of the overlying stratum in the direction of extraction, and the position of the leading overlying stratum disk during the subsequent extraction run of the disk shearer loader is oriented thereto, and whereby the position of the trailing footwall disk is established based on the assumption that the thickness of the seam remains the same. The drawback of this technique is that the detection of the stone bands via the infrared camera is effected under very unfavorable environmental conditions, such as dust, heat, vibrations, so that it is not always possible to precisely detect stone material bands in the seam layer. After recognition and localization of the stone material bands, the cut guidance of the disks is controlled in conformity with the established spacing relative to the overlying stratum and footwall. Deviations in particular from the seam thickness that is taken as a basis can lead to deviations of the cutting guidance of the trailing footwall disk relative to the course of the boundary layer or interface. Furthermore, the established maximum thickness must always be cut in order that no coal be annexed. To the extent that in the geology the distances of the stone material bands, which are used as a guide parameter for the cutting guidance, relative to the overlying stratum and to the footwall fluctuate, deviations of the cutting guidance that are caused by the system are unavoidable, since the distances of the stone material bands relative to the overlying stratum and to the footwall are assumed to be constant.

To the extent accordingly that sufficiently pronounced bands of stone material are present in the seam being worked or mined, incorporating this stone band as a guide parameter for the cutting guidance of the overlying stratum disk into the inventive control can have the advantage that the position of the overlying stratum seam can be constantly checked on the basis of the data captured from the position of the shield support units, so that incorrect controls of the cutting work are avoided.

In this regard, the course of the overlying stratum determined from the ascertained angles of the course of the overlying stratum in the region of the shield support frames can be compared, for adjustment purposes, with the cutting profile of the disk shearer loader prescribed by the trial run and/or on the basis of the determination of the position of a stone band, and with a cut of the disk shearer loader into the overlying stratum, which can be established by a computer, a correction of the cutting guidance of the leading overlying stratum disk is undertaken to adapt to the course of the overlying stratum, whereby furthermore an adaptation of the cutting guidance of the trailing footwall disk to a correction of the cutting guidance of the leading overlying stratum disk is undertaken to produce the defined face opening.

Furthermore, DE 20 2007 014 710 U1 presents the proposal, by means of a radar sensor that is mounted on the machine body of the disk shearer loader, between its disks, and is directed toward the coal face, of determining during the extraction run the course of the overlying stratum in the direction of extraction, so that the course of the overlying stratum layer can be ascertained. These measures are also usable in the framework of the control of the present invention, whereby it is provided that the course of the overlying stratum layer determined by means of radar be compared, for adjustment purposes, with the course of the overlying stratum derived from the position of the shield support frames, and hence from the determined angles of the course of the overlying stratum; if necessary, a correction of the cutting height of the disk shearer loader is undertaken. In addition, by means of the radar sensor the course of the footwall layer in the direction of extraction of the disk shearer loader can additionally be determined, and the position of the trailing footwall disk, relative to the position of the footwall layer, is ascertained and if necessary the disk position is corrected. In this way, the precision of the cutting work of the disk shearer loader can on the whole be improved.

Finally, from the publication "Inertial Navigation: Enabling Technology for Longwall Mining Automation" by D. C. Reid, of D. W. Hainsworth, J. C. Ralston, R. J. McPhee & C. O. Hargrave, CSIRO, Mining Automation, 1 Technology Court, Pullenvale, Qld, Australia 4069, it is known by means of sensors mounted on the disks, and suitable for carrying out an inertial navigation, to detect the respective position of the disks in the area of the face in a continuous manner and in the form of spatial coordinates, and with a series of sequentially coupled spatial coordinates detected during an extraction run, to reproduce the extraction channel respectively cut free by the disks in a three-dimensional space. Herewith it is possible to ensure a quality of the cutting guidance of the disks of the disk shearer loader that remains the same, and also, with previously known changes of the seam parameters, to adapt the cutting guidance of the disks by presetting the spatial coordinates that are to be achieved. However, this known method, similar to the aforementioned trial run process, also has the drawback that no automatic orientation of the cutting guidance of the disk shearer loader is provided at the seam layer, and that the actual course of the overlying stratum layer is not used as a control parameter for the cutting guidance. These drawbacks can be eliminated by including the aforementioned detection of the disk position via spatial coordinates for the inventive control in that the extraction channel reproduced in the three-dimensional space is compared, for adjustment purposes, with the geometry of the face area calculated using the position of the shield support frames. To the extent that with the calculation of the geometry of the face area the position of the face conveyor, with forward advancing of the working, is extrapolated by the stepping or advancing cylinder path measurement, errors caused by the system occur that continuously accumulate, so that the position of the face conveyor assumed in the face area noticeably deviates from the actual face conveyor position. By the detection of the position of the disks, and hence also the position of the face conveyor, on the basis of spatial coordinates captured by inertial navigation, it would be possible with each extraction run to additionally detect the absolute position of the face conveyor, and to synchronize it with the assumed face conveyor position in the geometry of the face area, so that, for example commercially undesirable, correction measurements are no longer necessary, and the aforementioned errors no longer accumulate over many stepping cycles of the shield support frames.

This way of proceeding can also be applicable in that, by means of the series of extraction channels in a three-dimensional space reproduced for a plurality of successive extraction runs, a model is established for the course of the seam layer in the direction of working, and is compared, for adjustment purposes, with a seam layer course model calculated on the basis of the geometry of face areas respectively calculated for a sequence of a plurality of extraction runs.

Pursuant to one embodiment of the invention, further supplemental control measures can be provided in that by means of at least one radar sensor mounted on the disk main body of the disk shearer loader, the distance between the upper edge of the disk main body and the underside of the top canopy of the shield support frame below which travel is accomplished during the extraction work is measured and is input into a computer as the actual value for the passage height of the disk shearer loader below the shield support frames, where it is compared, for adjustment purposes, with a stored target value, whereby if a deviation is ascertained, control commands are generated for an adaptation of the cutting height of at least one of the two disks of the disk shearer loader.

This has the advantage that the control objective of maintaining a defined face opening during the extraction runs of the disk shearer loader can be achieved at relatively low expenditure. The passage height, which is measured as the distance between the upper edge of the machine body and the underside of the top canopy of the shield support frames, is a direct measure also for the face opening, since the face opening is composed of the passage height and the distances, assumed by the longwall equipment, and hence unchangeable, relative to the overlying stratum on the one hand and to the footwall, or the footwall layer cut free by the footwall disk, on the other hand. For example, the distance to the overlying stratum, which exceeds the passage height, is prescribed by the dimensions of the top canopy, while the distance of the radar sensors to the footwall layer is prescribed by the overall height of the face conveyor that rests upon the footwall layer, and of the machine body of the disk shearer loader that can travel thereon. Thus, the value respectively measured for the passage height can be used directly as a synonym for the height of the face opening. The control operations can thus be carried out more rapidly. The target value for the face opening prescribed in the computer is prescribed either by the deposit or seam data, in other words in particular by the seam thickness, or, however, is also determined by the minimum passage height of the longwall equipment. Also the target value can similarly be represented as a target value for the passage opening as a function of the construction data of the longwall equipment.

Pursuant to one embodiment of the invention, the determination of the face height carried out on the basis of the radar measurement can be supplemented in that from the data captured at the shield support frames, the respective height that is perpendicular to the stratification of one of the shield support frames at the forward end of the top canopy is calculated as a measure for the actual face opening, and the thus determined actual value of the shield height calculation is conveyed to the computer that processes the actual values from the passage height measurement. While the radar measurement respectively delivers data only during the passage of the extraction machine below the respective shield support frame, and thus does not recognize a passage height that is too low from the outset, and cannot be taken into account when the extraction parameters are established, the supplemental determination of the face opening at the forward end of the top canopy has the advantage that the data thus obtained at the individual shield support frames provide additional information regarding the condition of individual sections of the face front, or of the entire face front, as extraction proceeds.

Thus, from the relationship of the calculated and measured face opening to the deposit or seam data that is applicable for the respective mining operation, such as, for example, a seam thickness that possibly changes over the length of the face, one can from the outset deduce therefrom whether the danger exists of getting hung up within the longwall equipment from the overlying stratum applying load to the shield support frames, or if there is a threat of exceeding the upper adjustment limit of the shield support frames with a desired automatic operation. The aforementioned instances of danger are applicable in particular when traveling through saddles or troughs in the course of the seam, which can be taken into account right from the outset by an appropriate adaptation of the cutting height of the disk shearer loader. Furthermore, the corresponding face opening data can provide information regarding a possible caving-in from the overlying stratum, the occurrence of narrowing of the seam, a traveling of the disk shearer loader "on coal", and/or a possible cutting into the footwall by the disk shearer loader.

Thus, the detection of the shield height delivers data for a preview of the face opening that is to be anticipated, which can then be compared, for adjustment purposes, with the data measured by the disk shearer loader as it passes through. Thus, the accuracy of the two manners of proceeding can be better evaluated. To this extent, the two manners of proceeding supplement one another, thus providing a redundancy when checking the respective face opening. A further advantage is that even if one of the two systems for determining the face opening fails, the extraction can continue on the basis of the remaining measurement system.

If, pursuant to one embodiment of the invention, additionally the correction values for the cutting height of the disks established during successive extraction runs by the respectively generated control commands are compared with one another for adjustment purposes, and the summation value determined from the correction values is used as a measure for a convergence that occurs, which with future extraction runs is taken into account in the establishment of a necessary adaptation of the cutting height of the disks, it is possible in this manner to draw conclusions concerning a convergence that occurs in the meantime. If during a first extraction run a requirement for correction for the cutting height results, then for the following extraction run one can check whether after carrying out the correction the prescribed face opening is cut free. If, however, there results a renewed requirement for correction, this can be brought about only by a convergence that has occurred in the meantime.

BREIF DESCRIPTION OF THE DRAWINGS

Figure 2:
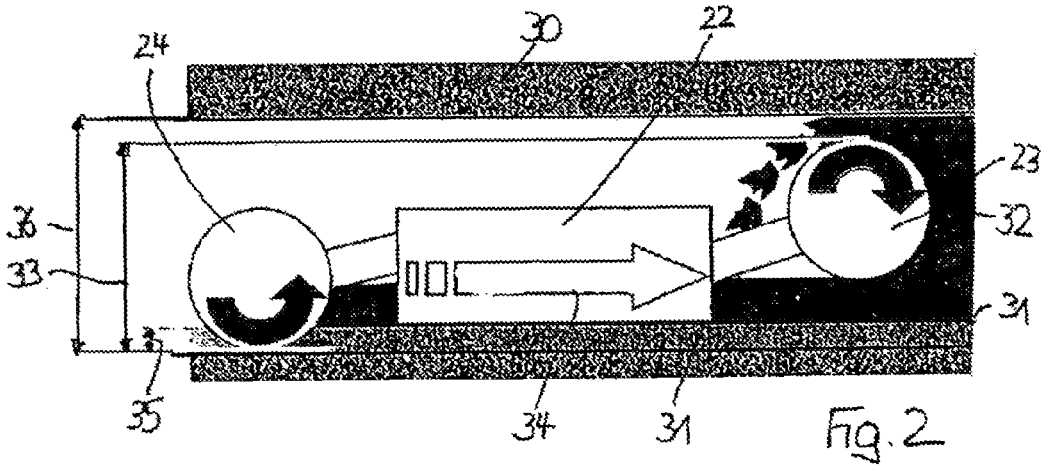
Figure 3A:
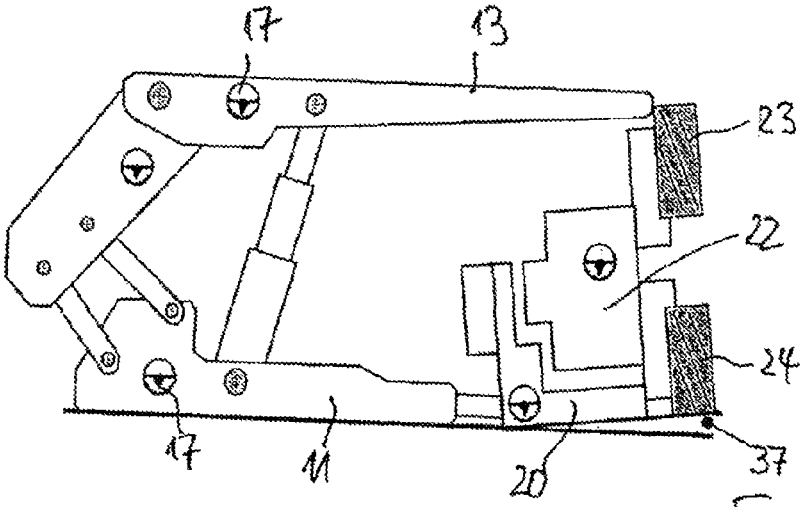
Figure 3B:
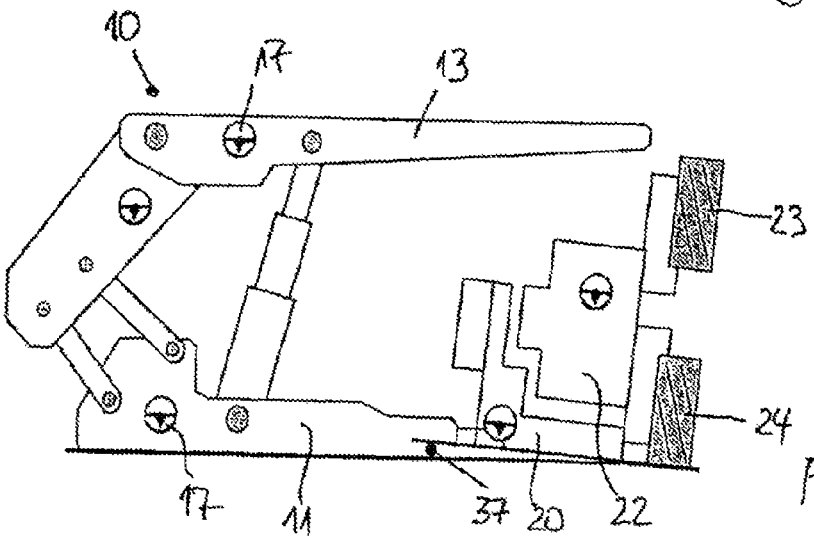
Figure 4:
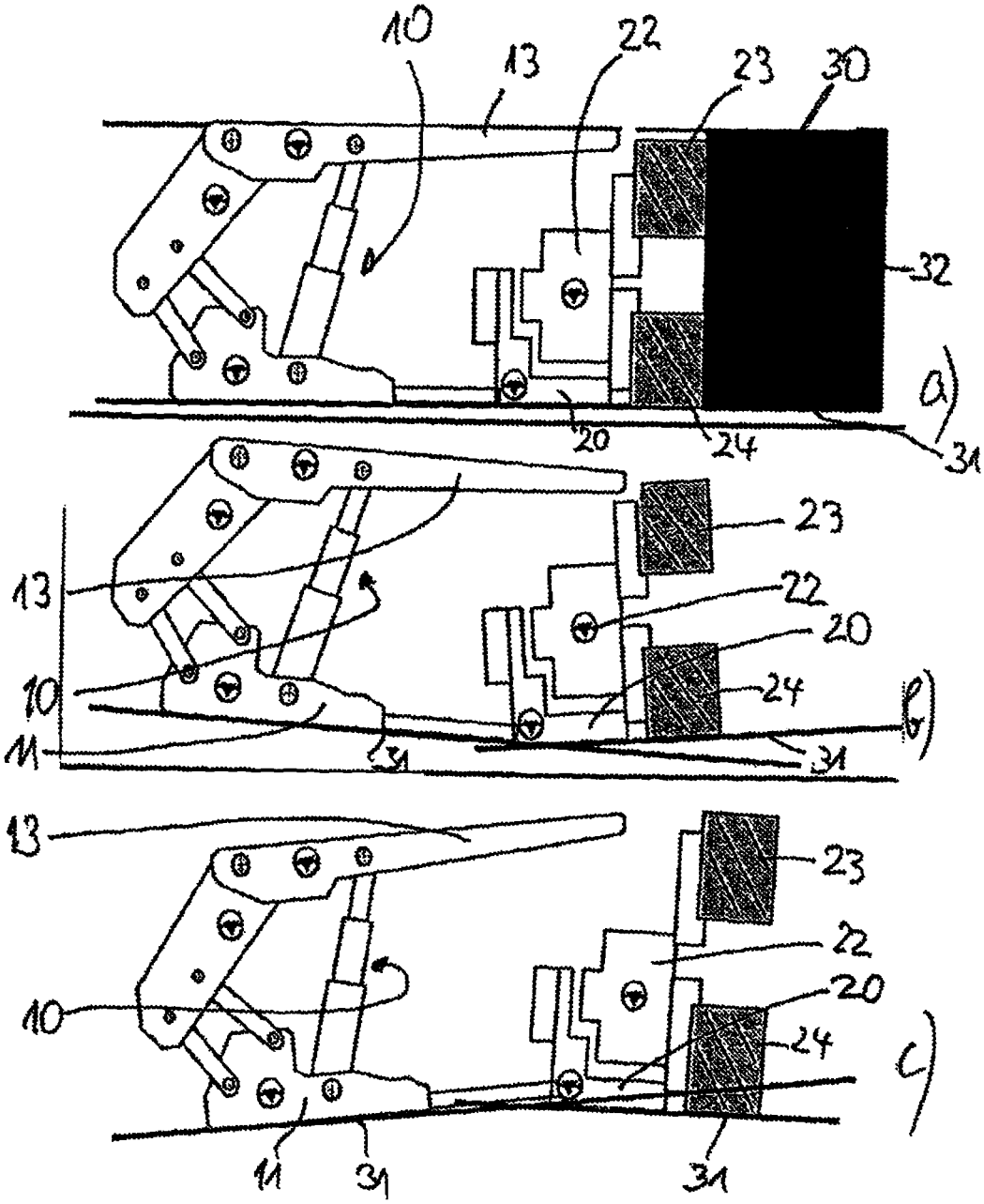
Figure 5:
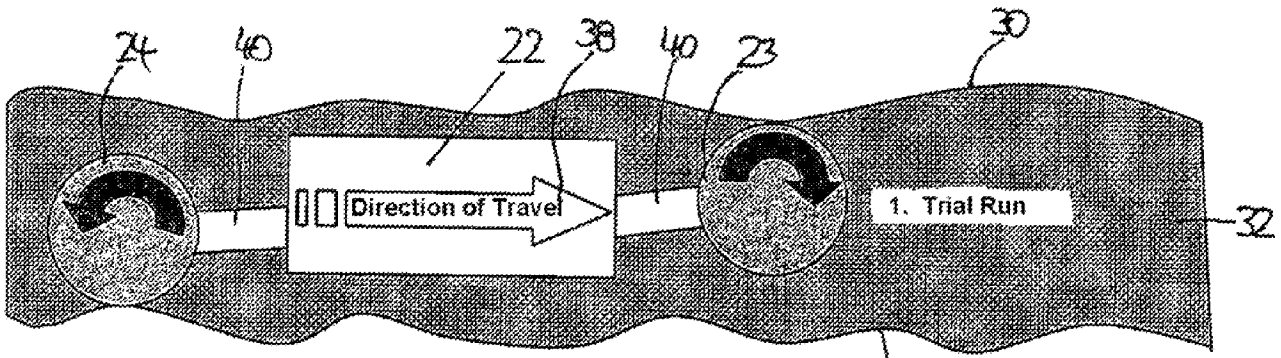
Figure 6B:
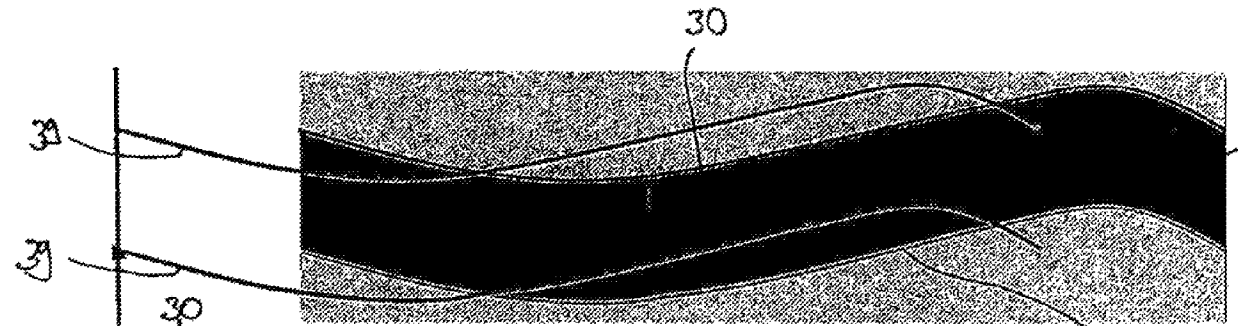
Figure 6A:
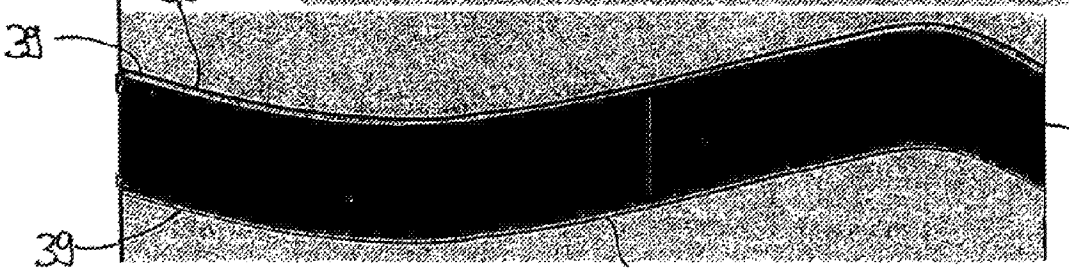
Figure 7:
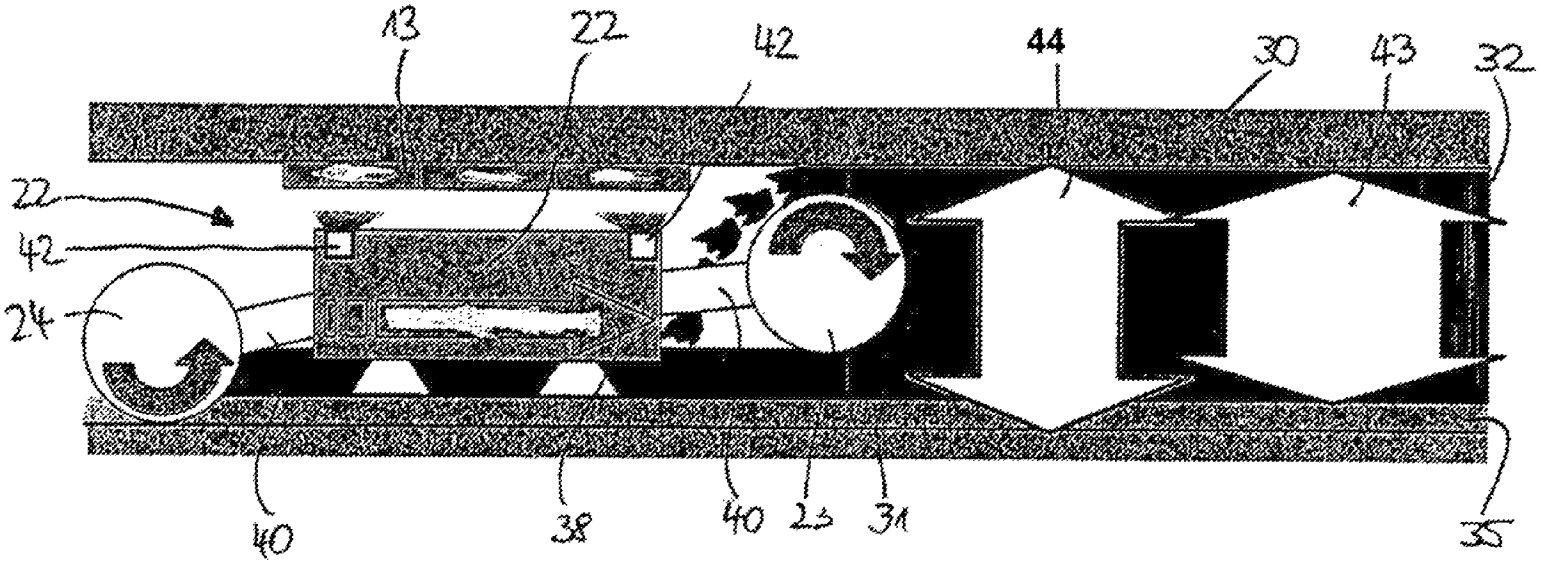
Figure 8:
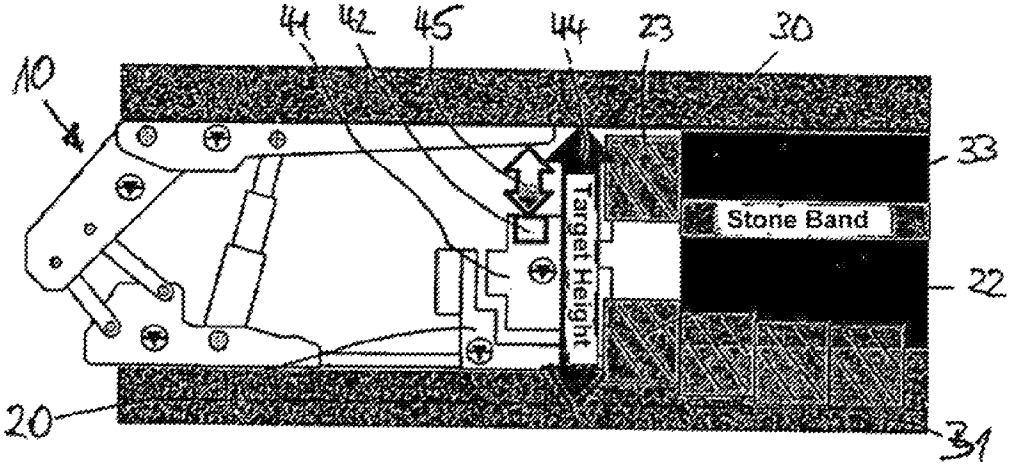

Exemplary embodiments of the invention, which will be described subsequently, are illustrated in the drawings, in which:

FIG. 1 is a schematic side view of a shield support frame having inclination sensors disposed thereon, in conjunction with a face conveyor and a disk shearer loader as an extraction machine, FIG. 2 is a schematic illustration of the longwall equipment of FIG. 1 in use or operation, FIG. 3*a* shows the longwall equipment of FIG. 1 at a climbing tendency of the extraction machine, FIG. 3*b* shows the longwall equipment of FIG. 1 at a dipping tendency of the extraction machine, FIGS. 4*a-c* are schematic illustrations of the longwall equipment of FIG. 1 when traveling through troughs and traveling over saddles, FIG. 5 is a schematic illustration of a trial run of the disk shearer loader that serves for establishing a cutting profile, FIGS. 6*a, b* are schematic illustrations showing the influence of a change of the seam conditions upon the established cutting profile, FIG. 7 is a schematic front view, as viewed in the direction of working, of a longwall equipment having a disk shearer loader and shield support frames, illustrated merely with their top canopies, in operation, FIG. 8 is a side view of the longwall equipment of FIG. 7.

DESCRIPTION OF SPECIFIC EMBODIMENTS

With the aid of the figures, which will be explained subsequently, the underlying principles of the inventive method, as it enables detection or acquisition of the cutting height, will be explained in greater detail.

The longwall equipment illustrated in FIG. 1 primarily comprises a shield support frame 10 having a floor skid 11, on which two props 12 are attached in a parallel configuration, of which only one prop is recognizable in FIG. 1; on its upper end, the prop supports a top canopy 13. While the top canopy 13 protrudes in the direction of the disk shearer loader, which will be described below, at its front (left) end, a gob shield 14 is linked to the rear (right) end of the top canopy 13 by means of a joint 15, whereby in the illustrated side view the gob shield is supported by two supporting connection rods 16, which rest on the floor skid 11. In the illustrated exemplary embodiment, three inclination sensors 17 are attached to the shield support frame 10, and in particular one inclination sensor 17 on the floor skid 11, one inclination sensor 17 in the rear region of the top canopy 13 in the vicinity of the joint 15, and one inclination sensor 17 on the gob shield 14. Although not illustrated, an inclination sensor can also be provided on the fourth movable component of the shield support frame 10, namely the supporting connection rods 16, whereby of the four possible inclination sensors 17, in each case three inclination sensors must be installed in order with the inclination values determined therefrom, to be able to determine the position of the shield support frame in its working area. Thus, the present invention is not limited to the arrangement of the inclination sensors concretely illustrated in FIG. 1, but rather includes all possible combinations of three inclination sensors on the four movable components of the shield support frame.

The shield support frame illustrated in FIG. 1 is attached to a face conveyor 20, which is also provided with an inclination sensor 21, so that in general with respect to the control of the longwall equipment, here also data with respect to the face conveyor location may be obtained. A disk shearer loader 22 having an upper disk 23 and a lower disk 24 is guided on the face conveyor 20, with an inclination sensor 25 also being disposed in the region of the disk shearer loader 22, as well as a sensor 26 for acquiring the respective location of the disk shearer loader 22 in the face or longwall, as well as reed bars 27 for measuring the cutting height of the disk shearer loader 22. The setting-up of the longwall equipment for measuring techniques is supplemented by the provision of sensors 18 on the props 12, by means of which the change of the height position of the top canopy 13 is possible by determining the degree of extension of the prop 12. Furthermore, a distance measuring system 19 is integrated into the floor skid 11, by means of which the respective stepping or advancement travel of the shield support frame 10 in relationship to the face conveyor 20 can be established. Since the face conveyor 20 is advanced in the direction of the coal face by means of cylinders that are supported on the shield support frame 10, the stepping or advancement travel carried out by the shield support frame 10 as it is pulled after equates to the cutting depth of the disks of the shearer loader 22. As already mentioned, the arrangement of the inclination sensor 21 on the face conveyor 20 is not absolutely necessary to the extent that the inclination sensor 25 is installed on the disk shearer loader 22. In such a case, the inclination sensor 21 can additionally be provided to improve the precision of the measurement.

During operation of the longwall equipment of FIG. 1, there generally results an operating situation such as that illustrated by way of example in FIG. 2. A seam layer 32 that exists between a roof or overlying stratum 30 and a floor or footwall 31 is extracted by the disk shearer loader 22, whereby the cutting height 33 of the disk shearer loader 22, which is advancing in the direction of travel 34, is established such that a footwall cut 35 is cut by the lower disk 24. The forward, upper disk 23 is set such that below the overlying stratum 30, it allows a narrow coal layer to remain that, as a consequence of the cutting work, is automatically released from the overlying stratum. To this extent, the established cutting height 33 in FIG. 2 is registered. It is apparent that in this case the shield height 36 is set higher than the cutting height 33, so that one can assume a collision free passage of the disk shearer loader 22 below the shield support frames 10.

In order, proceeding from FIG. 2, to explain the possible different or variable performance actions of the longwall equipment during the extraction operation, FIGS. 3*a* and 3*b* illustrate the conditions that result when the disk shearer loader 22 has a climbing tendency or slope relative to the shield support frame 10 (FIG. 3*a*), which manifests itself in the formation of a differential angle 37 between the floor skid 11 and the lower disk 24 of the disk shearer loader 22. It can be seen that in such a case the danger of a collision between the disk shearer loader 22 and the shield support frames 10 increases, and this risk can be taken into account by a change of the cutting height. A comparable circumstance exists for the situation illustrated in FIG. 3*b*, where the disk shearer loader 22 has a dropping or dipping tendency. Here also a corresponding differential angle 37 is established that can be determined with the aid of the positions of disk shearer loader 22 and shield support frame 10 detected by the inclination sensors 17 or 25 and 21, with the respectively occurring differential angles 37 being appropriately taken into consideration during the face control.

As a supplement, FIGS. 4*a* to 4*c* illustrate the conditions that are exhibited during travel through troughs or when traveling over saddles in the seam. As can be seen first of all from a comparison of FIG. 4*b* with FIG. 4*a*, encountering a trough (FIG. 4*b*) leads to an inclination position of face conveyor 20 and disk shearer loader 22 that can be detected via the inclination sensors 21 and 25 respectively that are disposed thereon. The inclination values captured here can be compared with the inclination values captured at the shield support frame 10, and from this comparison there results a differential angle which can be related to the respective contact surface of the shield support frame 10 and the face conveyor 20, with its extraction machine 22, upon the footwall 31. With the travel through a trough as illustrated in FIG. 4*b*, there results a differential angle of less than 180 degrees, and this leads to a reduction of the, in FIG. 4*a* still existing, spacing between the disk shearer loader 22 and that end of the top canopy 13 that faces the coal face. In order to eliminate the risk of collision that is connected therewith, it is possible in such a situation to not pull the shield support frame 10 after by the full amount; rather, the shield support frame remains somewhat behind relative to the face conveyor 20 with its disk shearer loader 22 in order to maintain a through-passage spacing.

A reverse situation results when traveling over a saddle, as this is illustrated in FIG. 4*c* in comparison with FIG. 4*a*. Here, there results a differential angle greater than 180 degrees, which means that in the region of the roof or overlying stratum, the spacing between the top canopy 13 and the disk shearer loader 22 is opened up. To avoid a disadvantageous operating situation, in an automatic procedure the shield support frame 10 is pulled forward by the entire stepping or advancing path, but the cutting depth of the disk shearer loader 22 is reduced.

To the extent that in each case above the inclusion of the determined shield height into the control is described, it should be noted that already the arrangement of an inclination sensor merely on the top canopy 13 of the shield frame 10 can be sufficient in order to in each case determine the angle of the course of the roof in the direction of working and/or in the direction of extraction of the disk shearer loader 22, to the extent that already the recognition of the course of the overlying stratum 30, and its use as a guide parameter for the cutting work, is sufficient.

FIGS. 5 and 6*a, b* illustrate the inclusion of a control technique, according to which at the beginning of the extraction of the disk shearer loader 22, a so-called learning or trial run is carried out, during which the roof disk 23 and the footwall disk 24 are each manually controlled along the respective overlying stratum 30 or footwall layer respectively.

The profile captured thereby is stored as a cutting profile and is respectively followed during subsequent extraction runs. As can be seen in this connection from FIG. 5, the disk shearer loader 22, with its disks 23 and 24, is moved in the direction of travel (arrow 38), whereby the disks 23, 24 are respectively moved along the overlying stratum 30 and the footwall layer 31. The lines 39 clearly indicate the cutting profile that is stored for the further extraction runs.

As can be seen in a simplified illustration from FIGS. 6*a, b*, maintaining the cutting profile illustrated in FIG. 6*a* by the lines 39 during a shifting of the wave-like orientation toward the right as shown in FIG. 6*b* leads to a drifting apart of the unchanged, followed cutting profile and the course of the seam layer 32. It is easily recognizable that with such a manner of operation of the disk shearer loader 22, the amount of rock that is cut along therewith greatly increases, whereby also the amount of "annexed" coal increases. The shifting of the wave-like orientation in the seam layer 32 can be detected by the non-illustrated inclination detection of the position of the shield support frames 10, which of course in particular follow the course of the overlying stratum 30 as a guide parameter, so that with these values the difference between the actual layer course and the established cutting profile becomes clear and can be appropriately corrected.

Although not illustrated, in addition to the determination of the face height, and hence to the determination of the course of the overlying stratum, as described in conjunction with FIGS. 1 to 4, the actual course of the overlying stratum can be determined by ascertaining stone bands or similar rock material embedded in the seam layer by means of an infrared camera that is disposed on the disk shearer loader 22, and is oriented toward the coal face, and, on the basis of a seam-inherent, known layer of the stone band in relationship to the overlying stratum to deduce the course of the overlying stratum in the direction of extraction. This enables a checking, and possibly correction, of the information obtained from the face height determination concerning the course of the overlying stratum. An alternative possibility is to determine the course of the overlying stratum in the direction of extraction during the extraction run by means of a radar sensor that is mounted on the machine body of the disk shearer loader, between its disks, and is directed toward the coal face, so that also herewith the actual course of the overlying stratum can be determined and can possibly be used as a correction parameter.

The use of radar technology for determining the face height is similarly possible pursuant to the exemplary embodiment described subsequently in conjunction with FIGS. 7 and 8.

As can first of all be seen from FIG. 7, a seam layer 32 that exists between the overlying stratum 30 and the footwall 31 is extracted by means of a disk shearer loader 22, which is provided with the cutting disks 23 and 24 that are supported on a machine body 41 via support arms 40. With the direction of travel of the disk shearer loader 22 along the seam layer 32 as indicated by the arrow 38, the cutting disk 23 operates as a leading cutting disk that cuts along the overlying stratum 30, while the cutting disk 24 that cuts along the footwall 31 operates as a trailing cutting, disk. The roof region of the seam layer 32 is supported by shield support frames 10 that are oriented perpendicular to the direction of travel 38 by the disk shearer loader 22. In FIG. 7, merely the top canopy 13 thereof can be seen.

In order to measure the passage height between the upper edge of the machine body 41 and the underside of the top canopy 13 of the pertaining shield support frame that respectively travels below during the extraction operation, disposed on the machine body 41 are two radar sensors 42 that are flushly inserted into the surface of the machine body 41. The radar sensors 42 emit signals perpendicularly upwardly in the direction of the top canopy 13 and again receive the reflected signals, so that the distance between the top canopies 13 and the machine body 14 can be determined in a straightforward manner, and in particular already early during the extraction run with the disk shearer loader 22. In the illustrated embodiment, the two radar sensors 42 are respectively disposed on the front and rear ends of the machine body 41, and are flushly inserted into the surface of the machine body 41. Although not illustrated, appropriate cleaning devices in the form of mechanical wipers or high pressure water rinsing devices can be provided.

As can be further seen in FIG. 7, the thickness of the seam layer 32, which is indicated by the arrow 43, is less than the minimum passage height of the longwall equipment, which is indicated by the arrow 44, so that to produce or maintain the minimum passage height 44, the trailing cutting disk 24 respectively carries out the footwall cut 35.

If the passage height 45 (FIG. 8) determined by the use of radar sensors 42 and found between the top canopy 13 and the machine body 41 is known, it is possible therefrom in a straightforward manner to also determine the actual height of the face opening, since the distance between the upper edge of the machine body 41 and the footwall 31 is prescribed with a fixed value from the steel structure comprised of the face conveyor 20, which rests upon the footwall layer, and the disk shearer loader 22 that travels thereon.

As then illustrated in FIG. 8, during the extraction operation the passage height, indicated by the arrow 45, between the top canopy 13 and the machine body 41 is determined by the radar sensors 42, from which the actual height of the face opening existing between the overlying stratum 30 and the footwall 31 can be determined. As can be seen from FIG. 8, this actual height of the face opening is less than the minimum passage height 44 of the longwall equipment, so that the trailing cutting disk 24 must during each extraction run respectively carry out an additional footwall cut in order to increase the overall freely cut height of the face opening in a stepwise manner. Since without any time delay the actually cut free height of the face opening is determined during each extraction run of the disk shearer loader 22, at the same time also a temporary raising of the footwall 31 caused by convergence is taken into account, the governing factor in each case being the actually cut free unobstructed height of the face.

The features of the subject matter of these documents disclosed in the preceding description, the patent claims, the abstract and the drawing can be important individually as well as in any desired combination with one another for realizing the various embodiments of the invention.

The specification incorporates by reference the disclosure of International application PCT/EP2009/006033, filed Aug. 20, 2009.

The present invention is, of course, in no way restricted to the specific disclosure of the specification and drawings, but also encompasses any modifications within the scope of the appended claims.

The invention claimed is:

1. A method of automatically producing a defined face opening, in underground coal mining, during longwall mining operations having a face conveyor, a disk shearer loader as an extraction machine, and a hydraulic shield support, said method including the steps of:

providing at least one inclination sensor on a top canopy of a frame of the shield support;

determining, via said at least one inclination sensor, an inclination of said top canopy, relative to a horizontal plane, to provide angles of a course of an overlying stratum at the shield support frame;

from said angles determining, in a computer, the course of said overlying stratum;

determining a stepping or advancement path length of said shield support frame by means of a distance measuring device disposed on a floor skid of said shield support frame;

from said stepping or advancement path length, determining a cutting depth of said disk shearer loader during an extraction run;

providing sensors on said disk shearer loader;

by means of said sensors on said disk shearer loader, detecting a cutting height of said disk shearer loader; and adjusting the cutting height of said disk shearer loader in alignment with a respective angle of the course of said overlying stratum to produce the defined face opening.

2. A method according to claim 1, wherein said shield support frame has four main components, including a floor skid a gob shield, supporting connection rods, and top canopy, and which includes the further steps of: determining, by means of said inclination sensors mounted on at least three of said four main components, the inclination of said top canopy relative to the horizontal plane, and from the measured data, in a computer, by comparison with base data stored in the computer that defines the geometrical orientation of said components and their movement during a stepping or advancement, determining a respective shield height, perpendicular to a stratification, in the region between said top canopy and said floor skid; from this determined shield height, taking into consideration an overall height of said top canopy and said floor skid, determining the height, perpendicular to the stratification, of a longwall that is cut free by said disk shearer loader; and on the basis of such obtained data, determining the geometry of the cut-free longwall at said shield support frame.

3. A method according to claim 1, which includes the further steps of: determining the cutting heights of a leading overlying stratum disk of said disk shearer loader that carries out an overlying stratum cut, and of a trailing footwall disk of said disk shearer loader that carries out a footwall cut, on the basis of sensors that detect the position of support arms of said disks; and, as said disk shearer loader passes by said shield support frame, specifying an overall cutting height in relationship to the face opening mathematically determined at the pertaining shield support frame.

4. A method according to claim 1, which includes the step of determining an inclination of said face conveyor and/or said disk shearer loader relative to the horizontal plane in a direction of stepping or advancement of said shield support frame by means of inclination sensors mounted on said face conveyor and/or said disk shearer loader.

5. A method according to claim 4, which includes the steps of specifying the angles of inclination of said face conveyor and/or said disk shearer loader in relationship to the angle of inclination determined at said floor skid of said shield support frame and/or at said top canopy, and including the differential angle formed therefrom in the calculation of the face opening that is established with a plurality of successive extraction runs of said disk shearer loader.

6. A method according to claim 1, which, if a shield height falls below the value for the cutting height of said disk shearer loader, includes the further steps of determining the convergence that occurs, and compensating for the convergence by adapting the cutting height of said disk shearer loader.

7. A method according to claim 1, which includes the further steps of: determining, via the determination of the inclination of said top canopy of said shield support frame in the direction of mining, the course of troughs and/or saddles in the direction of mining; via the determined changes in the inclination of said top canopy over a prescribed period of time, calculating the change of the face opening; and correspondingly setting a control of the cutting work of said disk shearer loader.

8. A method according to claim 1, which includes the further steps of: by means of a determination of the inclination of said shield support frame transverse to a direction of mining, determining the course of troughs and/or saddles in a direction of extraction of said disk shearer loader; and controlling a position of the said disk shearer loader in an area of the face such that the disks follow the ascertained course of the troughs or saddles.

9. A method according to claim 1, which includes the further steps of: prior to initiating extraction work and/or during an extraction where the course of a seam varies, carrying out a manually controlled trial run of said disk shearer loader, with manual alignment of disks thereof at said overlying stratum and relative to a footwall layer; and detecting a cutting profile of the trial run and storing the cutting profile in a computer in such a way that during extraction runs that are subsequent to the trial run, said disk shearer loader automatically follows the stored cutting profile.

10. A method according to claim 9, which includes the further steps of: during the trial run of said disk shearer loader, determining a longitudinal angle of inclination and/or a transverse angle of inclination of said disks of said disk shearer loader relative to a vertical plane; and using such determined angles when establishing the cutting profile that is to be followed, wherein angle deviations that occur during subsequent extraction runs are compensated for.

11. A method according to claim 1, which includes the further steps of: on the basis of data from an infrared camera that is disposed on said disk shearer loader, and is oriented toward the coal face, determining the position of stone bands embedded in a seam layer; on the basis of a known position of the stone band in relation to the overlying stratum , determining the course of the overlying stratum in the direction of extraction during an extraction run; orienting thereto the position of a leading overlying stratum disk of said disk shearer loader during a subsequent extraction of said disk shearer loader; and establishing the position of a trailing footwall disk of said disk shearer loader based on the assumption that the seam thickness remains the same.

12. A method according to claim 1, which includes the further steps of: comparing, for adjustment purposes, the course of the overlying stratum determined from the ascertained angles of the course of the overlying stratum in the region of the shield support frame with a cutting profile of said disk shearer loader prescribed by a trial run and/or on the basis of the determination of the position of a stone band; and, with a cut of said disk shearer loader into the overlying stratum, undertaking a correction of a cutting guidance of a leading overlying stratum disk of said disk shearer loader into the overlying stratum to adapt to the course of the overlying stratum.

13. A method according to claim 12, which includes the further step of undertaking an adaptation of the cutting guidance of a trailing footwall disk of said disk shearer loader to a correction of the cutting guidance of the leading overlying stratum disk of said disk shearer loader to produce the defined face opening.

14. A method according to claim 1, which includes the further steps of: by means of a radar sensor that is mounted on a machine body of said disk shearer loader, between disks thereof, and that is directed toward a coal face, determining the course of the overlying stratum in the direction of extraction during an extraction run; comparing, for adjustment purposes, the determined course of the overlying stratum with the course of the overlying stratum derived from the angles of the course of the overlying stratum; and, if necessary, undertaking a correction of the cutting height of said disks of the disk shearer loader based on such a comparison.

15. A method according to claim 14, which includes the further steps of: by means of the radar sensor, determining the course of a footwall layer in the direction of extraction of said disk shearer loader; ascertaining the position of a trailing footwall disk of said disk shearer loader relative to a position of said footwall layer; and, if necessary, correcting the position of said trailing footwall disk.

16. A method according to claim 1, which includes the further steps of: by means of sensors mounted on disks of said disk shearer loader, and suitable for carrying out an inertial navigation, detecting the respective position of said disks in the area of the face or longwall in a continuous manner and in the form of spatial coordinates; with a series of sequentially coupled spatial coordinates detected during an extraction run, reproducing, in a three-dimensional space, the extraction channel respectively cut free by the disks; and comparing, for adjustment purposes, the reproduced extraction channel with the geometry of the face area calculated using the position of said shield support frame.

17. A method according to claim 16, which includes the further steps of: by means of the series of extraction channels in a three-dimensional space reproduced for a plurality of successive extraction runs, establishing a model for the course of a seam layer in the direction of working; and comparing, for adjustment purposes, this model with a seam layer course model calculated on the basis of the geometry of face areas respectively calculated for a sequence of a plurality of extraction runs.

18. A method according to claim 1, which includes the further steps of: by means of at least one radar sensor mounted on the machine body of said disk shearer loader, measuring the distance between an upper edge of the machine body and an underside of said top canopy of said shield support frame below which travel is accomplished during extraction work; inputting this measured distance into a computer as the actual value for a passage height of said disk shearer loader below said shield support frame; comparing, for adjustment purposes, this actual value with a stored target value; and if a deviation is ascertained from such comparison, generating control commands in the form of correction values for an adaptation of a cutting height of at least one of two disks of said disk shearer loader.

19. A method according to claim 18, which includes the further steps of: from data captured at said shield support frame, calculating the respective height of the shield support frame that is perpendicular to a stratification at the forward end of said top canopy as a measure for the actual face opening; and conveying the thus determined actual value of the shield height calculation to the computer, which processes the actual values from the passage height measurement.

20. A method according to claim 18, which includes the further steps of: comparing the correction values for the cutting height of said disks of said disk shearer loader established during successive extraction runs by the respectively generated control commands with one another for adjustment purposes; and using a summation value determined from the correction values as a measure for a convergence that occurs and taking this into account with future extraction runs in an establishment of a necessary adaptation of the cutting height of said disks.

* * * * *